US007182332B2

(12) United States Patent
Pittelkow

(10) Patent No.: US 7,182,332 B2
(45) Date of Patent: Feb. 27, 2007

(54) FEED DEVICE FOR STACKS OF PAPER, PLASTIC MATERIAL OR THE LIKE

(75) Inventor: Ralph Pittelkow, St. Georgen (DE)

(73) Assignee: Mathias Bäuerle GmbH, St. Georgen (DE)

( * ) Notice: Subject to any disclaimer, the term of this patent is extended or adjusted under 35 U.S.C. 154(b) by 0 days.

(21) Appl. No.: 10/708,790

(22) Filed: Mar. 25, 2004

(65) Prior Publication Data

US 2004/0256788 A1 Dec. 23, 2004

(30) Foreign Application Priority Data

Mar. 28, 2003 (DE) ..... 103 14 694

(51) Int. Cl.
*B65H 1/02* (2006.01)

(52) U.S. Cl. ..... 271/150; 271/153; 271/10.02; 271/112

(58) Field of Classification Search ..... 271/31.1, 271/149, 150, 152, 153, 154, 94, 30.1, 112, 271/126, 155, 12, 10.02
See application file for complete search history.

(56) References Cited

U.S. PATENT DOCUMENTS 4,269,405 A * 5/1981 Mitzel ..... 271/94
4,323,230 A 4/1982 Rising ..... 271/12
4,593,895 A * 6/1986 Myers et al. ..... 271/148
4,971,310 A * 11/1990 Motegi et al. ..... 271/126
4,978,416 A 12/1990 Potter et al. ..... 156/571
5,100,022 A * 3/1992 Fukudome et al. ..... 221/198
5,354,045 A 10/1994 Boldrini et al. ..... 271/11
5,494,272 A * 2/1996 Golicz ..... 271/3.03
5,957,448 A * 9/1999 Frank et al. ..... 271/152
6,029,971 A * 2/2000 Lynch et al. ..... 271/34
6,270,070 B1 * 8/2001 Salomon et al. ..... 271/111
6,290,453 B1 * 9/2001 Corniani et al. ..... 414/798.9
6,461,102 B2 * 10/2002 Sting et al. ..... 414/798.9

FOREIGN PATENT DOCUMENTS

DE 42 00 186 7/1993
GB 917 754 2/1983
JP 58047741 A * 3/1983
JP 02018229 A * 1/1990

* cited by examiner

*Primary Examiner*—Patrick Mackey
*Assistant Examiner*—Matthew J. Kohner
(74) *Attorney, Agent, or Firm*—Gudrun E. Huckett

(57) ABSTRACT

A feed device for stacks of paper or plastic material has at least one transport unit with a supporting member for the stack and at least one transport element. A separating unit with at least one rotatably driven feed drum is provided for removing individual sheets from the stack. The transport unit transports the stack to the separating unit and is pre-tensioned in the transport direction toward the feed drum such that the stack rests with pretension against the feed drum. The pretension can be provided by a spring acting on the transport unit.

12 Claims, 3 Drawing Sheets

FEED DEVICE FOR STACKS OF PAPER, PLASTIC MATERIAL OR THE LIKE

BACKGROUND OF INVENTION

1. Field of the Invention

The invention relates to a feed device for stacks of paper, plastic material and the like. The device comprises a transport unit having a supporting member for the stack and at least one transport element for transporting the stack to a separating unit that has at least one rotatably driven feed drum.

2. Description of the Related Art

It is known to transport stacks comprised of vertically positioned sheets by means of a transport unit and to remove sheets individually from this stack. Since sheets are continuously removed, a gap results that must be closed so that the stack can still rest against the feed drum. The stack is monitored by means of a sensor. The stack rests on transport belts that are arranged stationarily. The transport belts are used for transporting the stack. The feed devices operate imprecisely and load the stack only unsatisfactorily. The spacing of the stack from the feed drum is measured by means of light sensors, inductive sensors or the like. Because of the switching hysteresis of the sensors, the pressure with which the stack rests against the feed drum changes constantly. This causes faulty removals or the simultaneous removal of two or three sheets from the stack.

SUMMARY OF INVENTION

It is an object of the present invention to configure the feed device of the aforementioned kind such that the sheets are removed individually and sequentially from the stack in a reliable fashion.

In accordance with the present invention, this is achieved in that the transport unit is pretensioned in the direction towards the feed drum such that the stack rests against the feed drum with pretension.

In the feed device according to the invention, the stack rests with pretension against the feed drums so that the sheets of the stack are removed uniformly and reliably from the stack. Since the transport unit for the stack is pretensioned, it is always resting with sufficient and uniform pressure against the feed drum. The feed drum therefore can remove individual sheets from the stack in a proper and reliable way.

DETAILED DESCRIPTION

Figure 1:
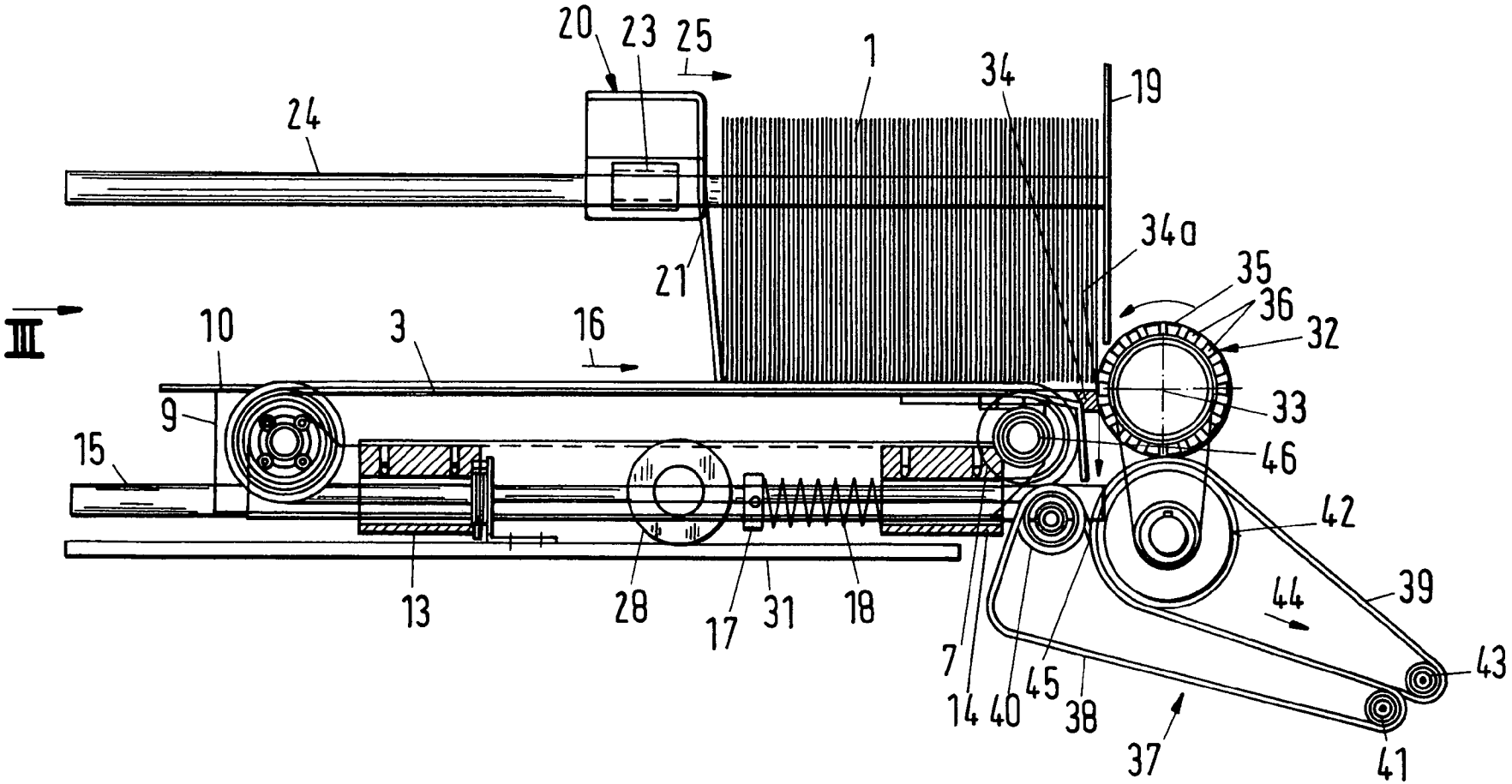
FIG. 1 shows a side view of the feed device according to the invention.
Figure 2:
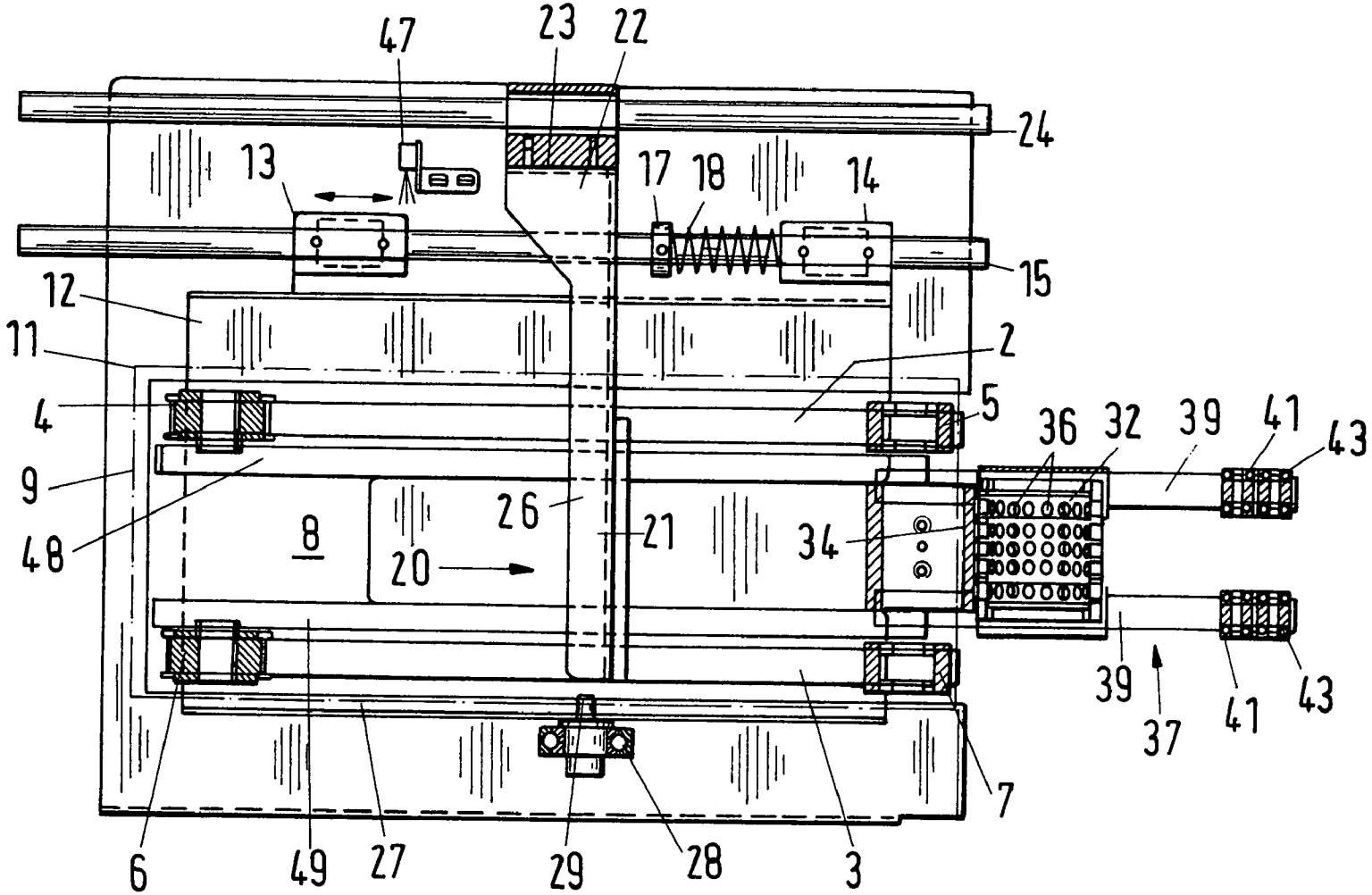
FIG. 2 is a plan view onto the feed device according to FIG. 1.

The feed device serves for reliably transporting stacks of paper, plastic material and the like to a separating unit. FIG. 1 shows a paper stack 1 whose sheets are upright. In the illustrated embodiment, two parallel belts 2, 3 are provided for transporting the stack and are positioned at a spacing to one another at the same level. The belts 2, 3 are endless circulating belts and are guided about rollers 4, 5; 6, 7 of which at least one roller is rotatably driven. The rollers 4, 5, 6, 7 are supported on two beams 48, 49 that extend parallel to one another (FIG. 2). The belts 2, 3 with the rollers 4–7 and the beams 48, 49 form a transport unit 8 with which the stack 1 is transported. The transport unit 8 has a supporting member in the form of a slide 9 that supports on its top side 10 the sheets of the stack 1 in the area adjacent to the belts 2, 3. The top side 10 of the slide 9 is provided with openings through which the upper runs of the belts 2, 3 project.

As illustrated in FIG. 2, the slide 9 has a rectangular contour in the illustrated embodiment. On a first longitudinal side 11, the slide 9 is provided with a lateral projection 12. Bearings 13, 14 are fastened to the projection 12 at a spacing relative to one another. The bearings 13, 14 are positioned on an axle 15 which extends parallel to the transport direction 16 (FIG. 1) and approximately at the level of the lower runs of the belts 2, 3.

On the stationary axle 15 in the area between the bearings 13, 14 an abutment 17 for a pressure coil spring 18 is provided. The spring 18 surrounds the axle 15 and rests with a first end against the abutment 17 and with a second end against the bearing 14 that is positioned in the transport direction 16 at a spacing from the abutment. In this way, the entire transport unit 8 is loaded in the direction toward the separating area.

The leading end of the stack 1 in the transport direction 16 is supported on a support plate 19 (FIG. 1). The trailing end of the stack 1 in the transport direction 16 is supported on a support unit 20. The support unit 20 comprises a support plate 21 that extends across the width of the stack 1 and is forwardly slanted across most of its height (FIG. 1) in the transport direction 16. In this way, the support plate 21 rests with its lower edge against the lower edge of the stack 1.

Figure 3:
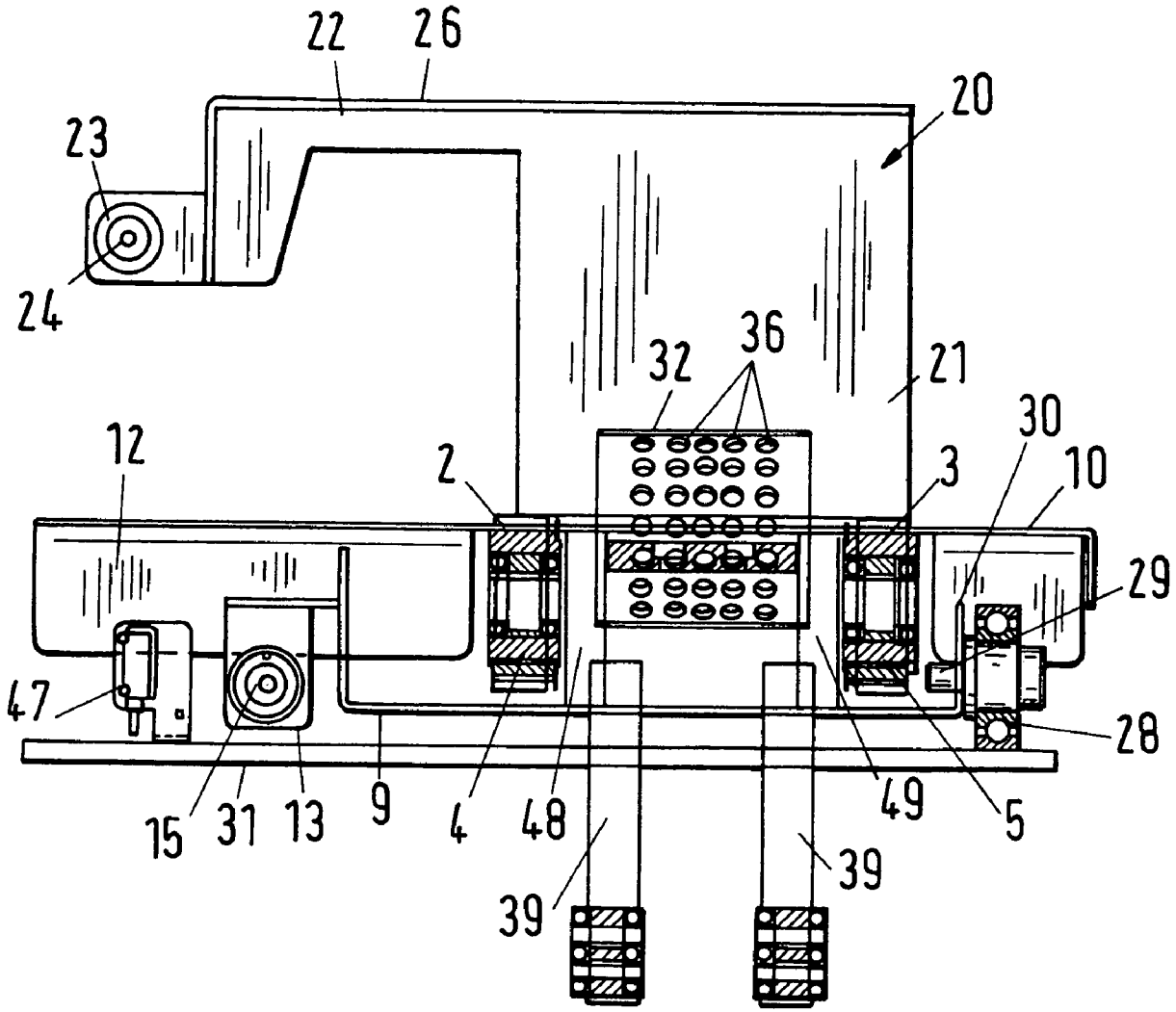
FIG. 3 is a view in the direction of arrow III of FIG. 1.

As illustrated in FIG. 3, an arm 22 laterally projects from the upper edge of the support plate 21. The arm 22 supports a bearing 23 mounted on an axle 24. When loading the stack 1, the support unit 20 can be moved on the axle 24; this is indicated in FIG. 1 by arrow 25.

The upper edge 26 of the support plate 21 is angled (FIG. 2) at a right angle in a direction opposite to the transport direction 16. This angled edge 26 extends across the length of the arm 22. The edge 26 is wider at the free end of the arm 22 (FIG. 2) so that the arm 22 has a great strength in the supporting area of the support unit 20. The width of the arm 22 corresponds in this area to the axial length of the bearing 23 so that the bearing is reliably secured. The support plate 21 rests with its lower edge on the slide 9 of the transport unit 8.

The axle 24 is positioned at a spacing above the top side 10 of the slide 9 (FIGS. 1 and 3). The lower edge of the support plate 21 engages the belts 2, 3 that are provided with a toothing on their back. The tooth spacing of the belts 2, 3 corresponds to the thickness of the support plate 21 that is thus reliably entrained. In this way, the support unit 20 can be moved together with the belts 2, 3 in the transport direction 16 so that the stack is supported on its trailing side at all times by the support plate 21.

The lower edge of the support plate 21 can be connected also by friction to the belts 2, 3. Instead of the belts it is also possible to employ transport elements in the form of chains and the like.

The slide 9 is provided with a support roll 28 on the longitudinal side 27 positioned opposite to the projection 12. The support roll 28 is provided in the illustrated embodiment at half the length of the slide 9. The support roll 28 is seated freely rotatably on axle 29 that is fastened on the upwardly positioned edge 30 (FIG. 3) of the slide 9. By means of the support roll 28, the side of the slide 9 opposite the axle 15 is supported on a support 31.

The support plate 19 ends at a minimal distance relative to the feed drum 32 (FIG. 1) that is rotatable about an axle that is horizontal and extends perpendicularly to the transport direction 16. As illustrated in FIG. 1, the axle 33 of the feed drum 32 is positioned at the level of the top side 10 of the slide 9. On the support 31 a pressing member 34 is fastened. It has a slanted edge 34*a* facing the feed drum 32. This edge 34*a* has advantageously a friction coating that is beneficial for the separating step. The pressing member 34 is arranged such that its slanted edge 34*a* forms together with the feed drum 32 a wedge-shaped gap 35. The pressing member 34 is advantageously adjustable for adjustment to different sheet thicknesses. The sheets of the stack 1 reach the wedge-shaped gap 35 individually and sequentially. The feed drum 32 is provided about its circumference with uniformly distributed passages (openings) 36. The feed drum 32 is connected to a vacuum source. The vacuum generated by the vacuum source acts through the passages 36 onto the sheet to be removed from the stack 1. The sheet is pulled by the vacuum tightly against the feed drum 32 and is thus reliably transported.

In the area underneath the feed drum 32 a removal device 37 is provided that has a total of four endless circulating belts 38 and 39 that are arranged in pairs (FIGS. 2 and 3). The belts 38, 39 are positioned above one another when viewed in a plan view according to FIG. 2. The pairs of belts 38, 39 are also parallel to one another and extends in the transport direction 16.

The belt 38 is guided about two rolls 40, 41 whose axes are parallel to one another and parallel to the axes of the rollers 4–7. The roll 40 is positioned approximately at the level of the lower run of the belts 2, 3 in the area underneath the rollers 5, 7. The belts 39 are also guided about a roll 42, respectively, that has a greater diameter than the roll 40. In the illustrated embodiment the rolls 42 have approximately the same diameter as the feed drum 32. The rolls 42 are arranged such that the belts 38 rest about a portion of the circumference against the rolls 42 (FIG. 1). Because of the rolls 42, the belts 38 are correspondingly deflected. The belts 39 are guided about rolls 43 that have the same diameter as the rolls 41 in this embodiment. In the area between the rolls 42 and 43, the belts 39 rest against the belts 38. Accordingly, the sheets of the stack 1 that are conveyed by the removal device 37 are transported in a flat position between the belts 38, 39 in the direction of arrow 44. The belts 38 are deflected at the rolls 41 and then returned by a deflection roll (not illustrated) to the rolls 40.

The belts 38, 39 form in the area of the rolls 40 and 42 a wedge-shaped insertion gap 45 (FIG. 1) so that the sheets can be fed reliably between the belts 38, 39.

In order for the individual sheets to be supplied reliably to the insertion gap 45, a guide plate 46 (FIG. 1) is provided that covers the rollers 5, 7 and projects into the vicinity of the insertion gap 45.

On the support 31 a light barrier (photoelectric barrier) 47 is provided which is positioned in the area between the axles 15, 24, when viewing a plan view of the feed device. In the illustrated embodiment, the bearing 13 is positioned in the monitoring area of the light barrier 47. As soon as the bearing reaches the area of the light barrier 47, the drive for the belts 2, 3 of the transport unit 8 is switched on so that the stack 1 and the support unit 20 are moved in the direction toward the feed drum 32. The stack 1 is thus pressed against the feed drum 32 and the lower end of the stack 1 is pressed against the periphery of the feed drum 32 (FIG. 1). The feed drum 32 rotates counter-clockwise and entrains the sheets reliably because of the vacuum that acts via passages 36 onto the leading sheet of the stack, respectively; in this way, the sheets are conveyed sequentially to the insertion gap 45. The belts 38, 39 engage the sheets and transport them away. The belts 38, 39 have a spacing from one another that corresponds to the width of the sheets of the stack 1 to be transported. As illustrated in FIGS. 2 and 3, the width of the feed drum 32 corresponds approximately to the spacing of the belts 38, 39 from one another.

When the sheets are removed sequentially from the paper stack 1 by means of the feed drum 32, the slide 9 is moved together with the belts 2, 3 under the load of the pressure spring 18 in the direction toward the feed drum 32. The support unit 20 is entrained by means of the support plate 21 cooperating with the belts 2, 3 so that the stack 1 is always safely supported. When the slide 9 is moved in this direction, the bearing 13 reaches the detection area of the light barrier 47. A switching signal is generated with which the drive of the belts 2, 3 is switched on. The stack 1 is then forced by means of the belts 2, 3 and the support plate 21 against the feed drum 32. Since the paper stack 1 is supported on the feed drum 32, the drive of the belts 2, 3 causes the entire transport unit 8 to be moved counter to the transport direction 16. As soon as the bearing 13 leaves the detection area of the light barrier 47, the drive of the belts 2, 3 is stopped. The slide 9 is loaded constantly by the pressure spring 18 in the transport direction 16 so that the stack 1 is loaded by the support plate 21. As soon as the bearing 13 reaches again the area of the light barrier 47, the drive of the belts 2,3 is again switched on.

In this way, a very sensitive loading or pushing of the stack against the feed drum 32 is ensured. By means of the pressure spring 18 a constant pressure can be adjusted simply in that the abutment 17 is clamped on the axis 15 at different positions in order to increase or reduce the pretension of the pressure spring 18. The switching hysteresis of the light barrier 47 is compensated by the pressure spring 18 so that the sheets are reliably removed from the stack.

When a new paper stack 1 is to be inserted into the device or to be added to the stack already positioned in the device, the support unit 20 is pivoted outwardly by means of the bearing 23 about the axle 24. The new paper stack 1 can then be easily inserted into the device. The support unit 20 that has been folded open can be moved into the new position, adjusted to the stack size, along the axle 24 and subsequently folded down into the stack-engaging position.

While specific embodiments of the invention have been shown and described in detail to illustrate the inventive principles, it will be understood that the invention may be embodied otherwise without departing from such principles.

What is claimed is:

1. A feed device for stacks of paper or plastic material, the feed device comprising:

at least one transport unit comprising a slide for the stack and at least one transport element;

wherein the slide and the at least one transport element are not drivingly connected to one another;

a separating unit comprising at least one rotatably driven feed drum;

wherein the at least one transport unit transports the stack to the separating unit;

wherein the slide is pretensioned in a transport direction toward the at least one feed drum such that the stack rests with pretension against the feed drum;

at least one sensor, wherein the at least one transport element is coupled to the at least one sensor that provides a switching signal for driving the at least one transport element, wherein the at least one sensor is a light barrier and wherein the switching signal is generated when a part of the slide enters a monitoring area of the at least one sensor when moving by the pretension in the transport direction;

a support unit for the stack resting on the slide, wherein the support unit rests against a side of the stack facing away from the feed drum;

wherein the support unit engages in a first engaging position the at least one transport element of the at least one transport unit and the at least one transport element and the support unit move the stack relative to the slide toward the separating unit when the switching signal is generated.

2. The feed device according to claim 1, further comprising at least one spring for pretensioning the slide.

3. The feed device according to claim 2, further comprising an axle and at least one bearing slidably mounted on the axle, wherein the at least one transport unit is connected to the at least one bearing and guided by the at least one bearing on the axle.

4. The feed device according to claim 3, further comprising an abutment mounted on the axle, wherein the at least one spring rests against the abutment.

5. The feed device according to claim 3, wherein the spring is a pressure spring surrounding the axle.

6. The feed device according to claim 1, wherein the support unit has at least one bearing guided on an axle.

7. The feed device according to claim 1, wherein the support unit has at least one support element that rests against the side of the stack facing away from the feed drum.

8. The feed device according to claim 1, wherein the at least one transport element is an endless circulating belt.

9. The feed device according to claim 1, wherein the at least one transport element is supported on the slide.

10. The feed device according to claim 1, wherein the feed drum is connected to a vacuum source.

11. The feed device according to claim 1, wherein the feed drum has passages.

12. The feed device according to claim 1, wherein the support unit is pivotable into a second disengaging position disengaged from the at least one transport element to allow insertion of a paper stack, wherein the support unit is moved by a length of the paper stack away from the feed drum before being pivoted back into the first engaging position.

* * * * *